US006105779A

United States Patent [19]

Simpson

[11] Patent Number: 6,105,779

[45] Date of Patent: Aug. 22, 2000

[54] LUNCH AND BOOK CARRIER

[76] Inventor: Richard E. Simpson, 141 Sierra Dr., Walnut Creek, Calif. 94598

[21] Appl. No.: 09/205,241

[22] Filed: Dec. 2, 1998

[51] Int. Cl.[7] ..... B65D 30/00

[52] U.S. Cl. ..... 206/542; 206/424

[58] Field of Search ..... 206/541, 542, 206/546, 424, 813; 190/111

[56] References Cited

U.S. PATENT DOCUMENTS

| | | | |
|---|---|---|---|
| 4,712,673 | 12/1987 | Moore | 206/542 X |
| 5,423,404 | 6/1995 | Shaw | 190/111 |
| 5,431,265 | 7/1995 | Yoo | 190/111 |

*Primary Examiner*—Jacob K. Ackun
*Attorney, Agent, or Firm*—W. Edward Johansen

[57] ABSTRACT

A lunch and book carrier includes a container, a divider, a first zipper, a second zipper, a book with a back, a fastening strip and a complementary fastening strip. The container has a first half portion with a first side edge and a second half portion with a second side edge. The divider has a first side edge and a second side edge. Each of the first and second zipper has a fastening track, a complementary fastening track and a track linking the fastening track to the complementary fastening track. The first zipper mechanically couples the first side edge of the container to the first side edge of the divider to form a first compartment. The second zipper mechanically couples the second side edge of the container to the second side edge of the divider to form a second compartment. The fastening strips are mechanically coupled to the back of the book and the container adjacent to the second compartment. The book is disposed in the second compartment and detachably coupled to the container.

1 Claim, 3 Drawing Sheets

LUNCH AND BOOK CARRIER

BACKGROUND OF THE INVENTION

The invention relates to a combination food carrier and amusement device and more particularly a lunch and book carrier.

A child between the ages of 1 and 4 years has a shorter attention span in relation to an older child. The process of feeding a child in these age groups can at times be difficult because the novelty of meal time is lost over time. Therefore the child will focus on other stimuli in their immediate environment.

U.S. Pat. No. 4,712,673 teaches a combination food carrier and amusement device which includes first and second panels having a removable bag member and a book secured to the inner surfaces thereof. The first and second panels are provided with removable handle portions which enable the device to transport food items retained in a bag member. The bag member and the handle portions are disposable so that the device remains as a unique amusement device and book. U.S. Pat. No. 4,936,462 teaches a story book which has two pages. The first page has the beginning part of a story displayed therein. The second page has the ending of the story located beneath a food tray, which when filled with food hides the story but when emptied of food reveals the story or theme ending. The story book has the following advantages. It becomes possible to maintain a child's interest in their food by insuring that the child's food will remain warm, keeping the process of feeding quick and simple, keeping meal time novel and utilizing this time in an educational manner. This is based upon utilizing a partitioned food tray which is shaped similar to a storybook and contains a narrative or story that the parent and child can progress through during feeding in an orderly manner which coincides with the sequence of courses during the meal. The story book provides a caretaker of a young child with a tool to gain increased child attention during the process of feeding, as well as to provide an additional educational medium. It allows easy compartmentalization of food, stimulates the child to eat in a sequential manner, and rewards the child with a completed story after completion of the meal. The left-hand side of the story book contains the narrative information which relates directly to a series of food wells on the opposite of the book. Key paragraphs and/or pictures in the sequence of the story remain obscured by food until the child eats the contents of the well and uncovers the bottom of the well which is transparent so that material below it can be read there through. As the child continues through the story he/she is required to eat the contents of the subsequent wells to uncover the next paragraph or picture in the story. This construction allows flexibility in that the trays can be made either disposable or re-usable depending upon the replacement of the story text and pictures. The food tray encourages a young children to finish his food during meal time by providing a food tray having food receptacles with clear bottoms. The food tray provides for placing a picture story under the tray, with pictures or text under the food receptacles so that the pictures and the story become uncovered as the meal progresses. As the child eats his way to the bottom of each clear bottom well, the picture story mounted thereunder becomes visible and provides a child with a "reward" for eating his food.

U.S. Pat. No. 5,653,471 teaches a nested book assembly for a child which includes a first book and a second book. The first book has a front cover, a back cover and a plurality of pages attached between the two covers. The second book has a front cover, a back cover and a plurality of pages attached between the two covers. The second book has a shape which substantially corresponds to the shape of a cavity formed in the front cover of the first book so that the second book may be frictionally retained within the cavity. The nested book assembly may include one or more puzzle pieces which are frictionally retained within one or more cavities formed in one or more of the books, the overall shape of each of the puzzle pieces substantially corresponding to the shape of a respective one of the cavities in which the puzzle pieces may be frictionally retained. The shape of the books and the puzzle pieces may represent a different portion of a person's face so that when the books and the puzzle pieces are frictionally retained within their respective cavities, the book assembly appears to resemble a person's face.

U.S. Pat. No. 4,094,085 and U.S. Pat. No. 4,170,303 teach a tray which can be converted into a picture frame apparatus. The tray has various areas which can be used to mount baseball cards after the tray has been used to carry beverages to one's seat, such as at a baseball game. The tray is designed to provide a support for a coffee cup. The support can then be removed to allow the insertion of baseball cards for displaying the same. A transparent bottom to the tray is not provided to support food so that pictures or text can be placed under the tray and viewed upon removal of the tray contents. No other food tray displays either text or pictures once the contents of the tray are either eaten or otherwise removed.

U.S. Pat. No. D-197,573, U.S. Pat. No. D-251,288 and U.S. Pat. No. 3,094,264 teach trays which have games or other entertaining displays thereon. U.S. Pat. No. 1,396,484 teaches a tray which has pictures formed thereon. U.S. Pat. No. 4,640,033 teaches a tray which has a picture formed thereon and a light within the tray to further enhance the picture displayed. U.S. Pat. No. D-198,387 teaches a child's feeding dish in which the food receptacles form a smiling face. All of the above-referenced patents have the disadvantage that none would be able to hold a child's attention during the course of feeding the child a meal.

U.S. Pat. No. 5,165,894 teaches an educational device in which a plurality of books are removably supported within a book tray. The book tray has a plurality of recesses formed therein, each of the recesses having a shape which generally corresponds to a respective letter of the alphabet, and each of the books has an overall shape which corresponds to the shape of one of the recesses formed in the book tray.

The inventor incorporates the teachings of the above-cited patents into this specification.

SUMMARY OF INVENTION

The present invention is generally directed to a combination food carrier and amusement device which includes a container. The container has a first half portion with a first side edge and a second half portion with a second side edge.

In a first, separate aspect of the present invention, the container is a lunch carrier and also includes a divider, a first zipper and a second zipper. The divider has a first side edge and a second side edge. Each of the first and second zipper has a fastening track, a complementary fastening track and a track linking the fastening track to the complementary fastening track. The first zipper mechanically couples the first side edge of the container to the first side edge of the divider to form a first compartment. The second zipper mechanically couples the second side edge of the container to the second side edge of the divider to form a second compartment.

In a second, separate aspect of the present invention, the container is a food and book carrier and also includes a book with a back, a fastening strip and a complementary fastening strip. The fastening strip is mechanically coupled to the back of the book. The complementary fastening strip is mechanically coupled to the container adjacent to the second compartment. The book is disposed in second compartment and detachably coupled to the container.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENTS

Figure 1:
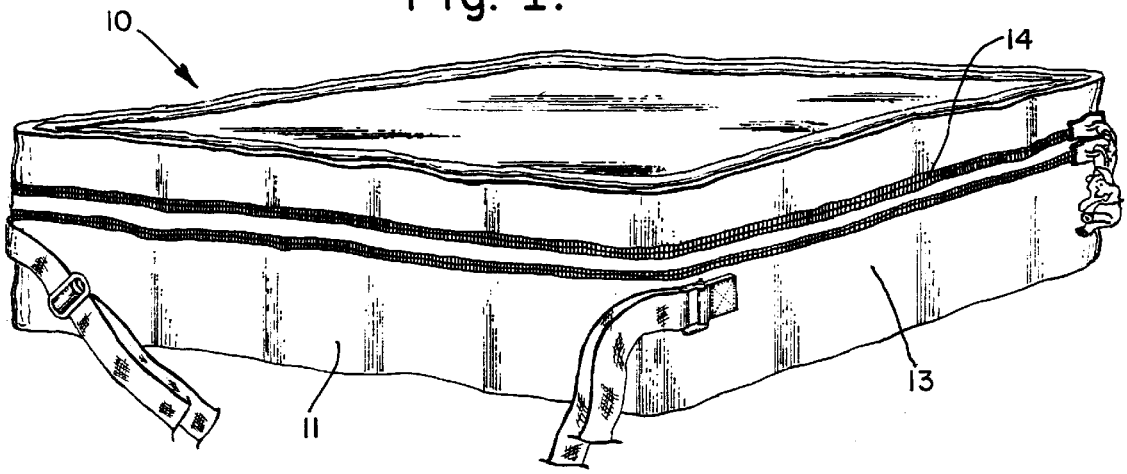
FIG. 1 is a perspective drawing of a lunch and book carrier according to the first embodiment of the present invention.
Figure 2:
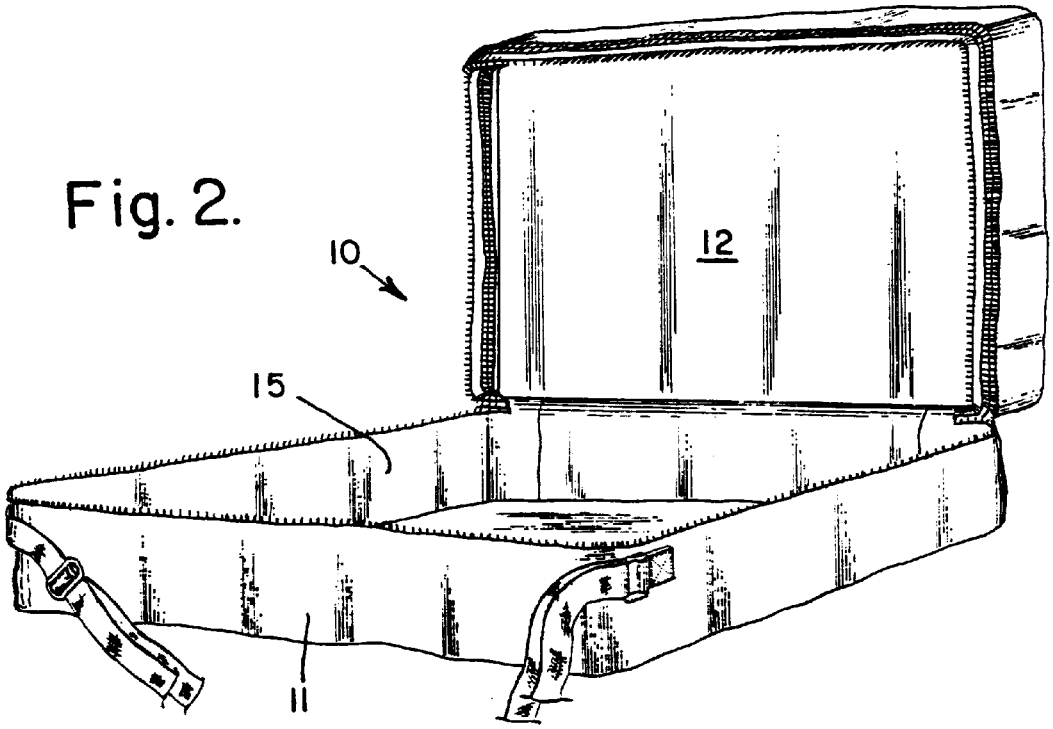
FIG. 2 is a perspective drawing of the lunch and book carrier of FIG. 1 which is opened in order to expose a first compartment thereof.

Referring to FIG. 1 in conjunction with FIG. 2 a lunch and book carrier 10 includes a container 11, a divider 12, a first zipper 13 and a second zipper 14. The container 11 has a first half portion with a first side edge and a second half portion with a second side edge. The divider 12 has a first side edge and a second side edge. Each of the first and second zipper 13 and 14 has a fastening track, a complementary fastening track and a track linking the fastening track to the complementary fastening track. The first zipper 13 mechanically couples the first side edge of the container 11 to the first side edge of the divider 12 to form a first compartment 15. A lunch may be stored in the first compartment 15.

Figure 4:
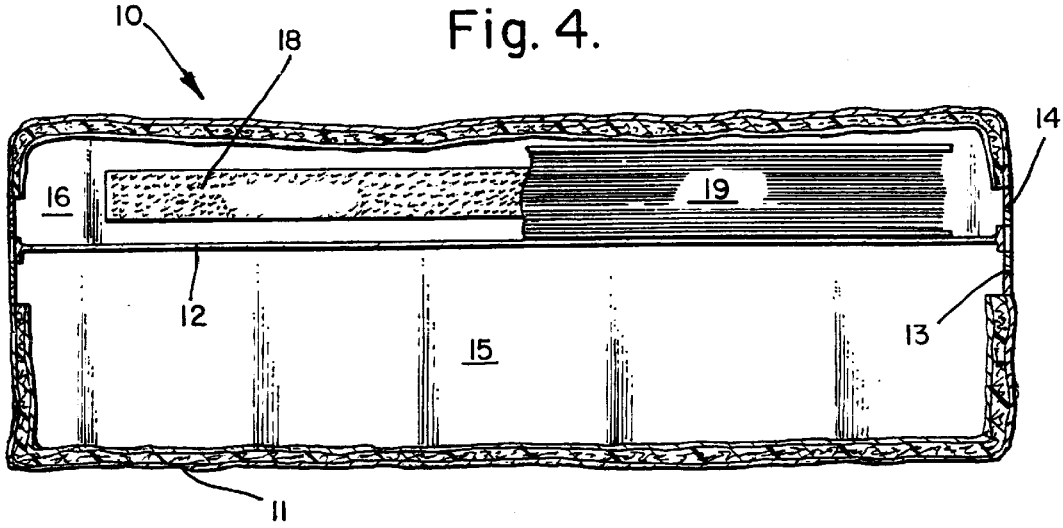
FIG. 4 is a cross-sectional view of the lunch and book carrier of FIG. 1 taken along line 4—4 of FIG. 1.
Figure 3:
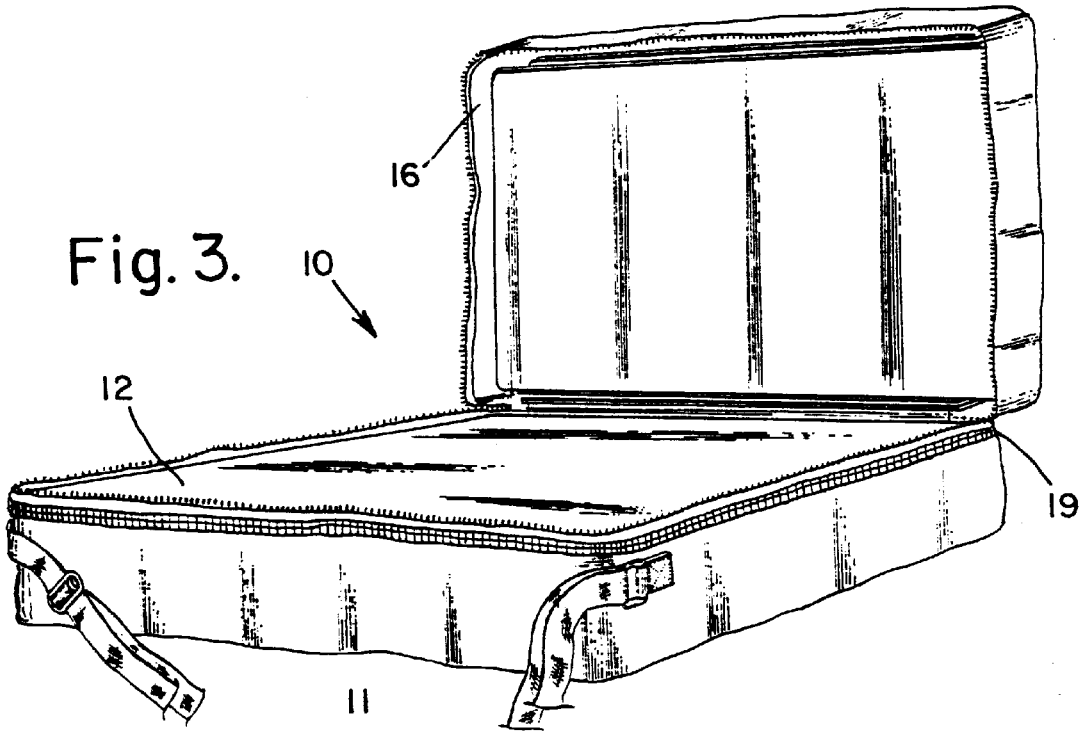
FIG. 3 is a perspective drawing of the lunch and book carrier of FIG. 1 which is opened in order to expose a second compartment thereof.

Referring to FIG. 3 in conjunction with FIG. 4 the second zipper 14 mechanically couples the second side edge of the container 11 to the second side edge of the divider 14 to form a second compartment 16. The lunch and book carrier 10 also includes a book 17, a fastening strip 18 and a complementary fastening strip 19. The fastening strip 18 is mechanically coupled to the back of the book 15. The complementary fastening strip 19 is mechanically coupled to the container 11 adjacent to the first compartment. The book 17 is disposed in the first compartment 15 and is detachably coupled to the container 11.

Figure 5:
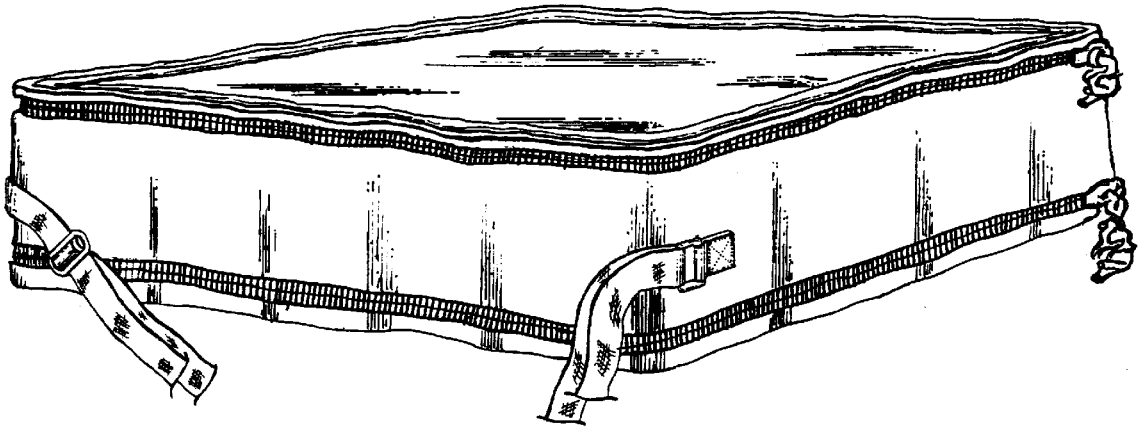
FIG. 5 is a perspective drawing of a lunch and book carrier according to the second embodiment of the present invention.
Figure 6:
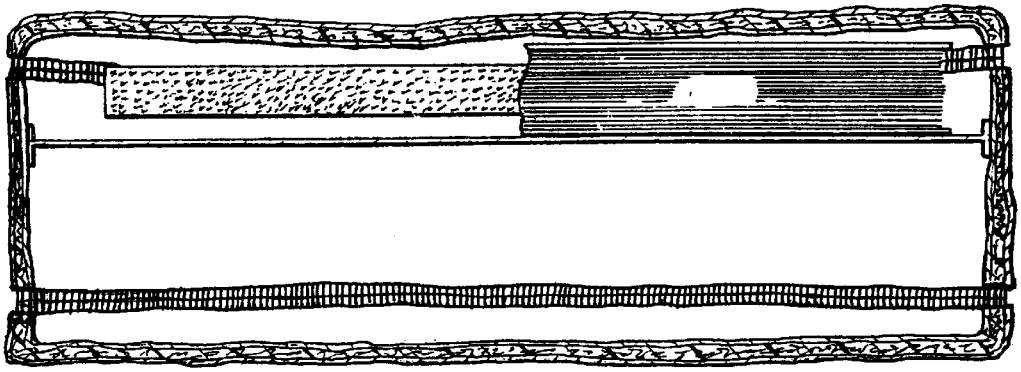
FIG. 6 is a cross-sectional view of the lunch and book carrier of FIG. 5 taken along line 6—6 of FIG. 5.

Referring to FIG. 5 in conjunction with FIG. 6 a lunch and book carrier 110 includes a container 111, a divider 112, a first zipper 113 and a second zipper 114. Each of the first and second zipper 113 and 114 has a fastening track, a complementary fastening track and a coupler linking the fastening track to the complementary fastening track. The container 111 includes a flat, flexible top member 116 and a flat, flexible bottom member 117 with a peripheral edge 118 and a peripheral edge 119, respectively. The container 111 also includes a flat, flexible side member 120 with a first peripheral edge 121 and a second peripheral edge 122. The first zipper 113 mechanically couples the peripheral edge 118 of the flat, flexible top member 116 to the first peripheral edge 121 of the flat, flexible side member 120 to form a first compartment 123. The second zipper 114 mechanically couples the peripheral edge 117 of the flat, flexible bottom member 117 to the second peripheral edge 121 of the flat, flexible side member 119 to form a second compartment 124. The divider 112 is attached to the inner wall of the container 111 and separates the first compartment 123 from the second compartment 124. A lunch may be stored in the second compartment 124. The lunch and book carrier 110 also includes a book 125, a fastening strip 126 and a complementary fastening strip 127. The fastening strip 126 is mechanically coupled to the back of the book 125. The complementary fastening strip 127 is mechanically coupled to the container 111 adjacent to the first compartment 123. The book 125 is disposed in the first compartment 123 and is detachably coupled to the container 111.

From the foregoing it can be seen that a lunch and book carrier has been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. A combination lunch and book carrier comprising:

a. a container having a first half portion with a first side edge and a second half portion with a second side edge;

b. a divider with a first side edge and a second side edge;

c. a first zipper having a fastening track, a complementary fastening track and a track linking said fastening track to said complementary fastening track, said first zipper mechanically couples said first side edge of said container to said first side edge of said divider to form a first compartment;

d. a second zipper having a fastening track, a complementary fastening track and a track linking said fastening track to said complementary fastening track, said first zipper mechanically couples said second side edge of said container to said second side edge of said divider to form a first compartment;

e. a book with a back;

f. a fastening strip mechanically coupled to said back;

g. of said book; and h. a complementary fastening strip mechanically coupled to said container adjacent to said second compartment whereby said book is disposed in second compartment and detachably coupled to said container.

* * * * *